United States Patent [19]

Farmer

[11] Patent Number: 4,653,235

[45] Date of Patent: Mar. 31, 1987

[54] SUPERABRASIVE GRINDING WITH VARIABLE SPARK-OUT AND WHEEL DRESSING INTERVALS

[75] Inventor: Steven P. Farmer, North Springfield, Vt.

[73] Assignee: Ex-Cell-O Corporation, Troy, Mich.

[21] Appl. No.: 800,001

[22] Filed: Nov. 20, 1985

[51] Int. Cl.[4] ..... B24B 49/18

[52] U.S. Cl. ..... 51/165.87; 51/165.93; 51/325

[58] Field of Search ..... 51/165.87, 165.88, 165.93, 51/165.8, 290, 325; 318/571

[56] References Cited

U.S. PATENT DOCUMENTS

| | | | |
|---|---|---|---|
| 3,344,560 | 10/1967 | Lillie | 51/165 |
| 3,535,828 | 10/1970 | Ware | 51/165.8 |
| 3,555,741 | 1/1971 | Hahn | 51/165 |
| 4,045,920 | 9/1977 | Fukuma | 51/165.93 |
| 4,123,878 | 11/1978 | Lizotte | 51/165.87 |
| 4,419,612 | 12/1983 | Reda | 318/571 |

*Primary Examiner*—Harold D. Whitehead
*Attorney, Agent, or Firm*—Edward J. Timmer

[57] ABSTRACT

During grinding of successive workparts with a superabrasive wheel in a rough grind stage at a high wheel infeed rate and a finish grind stage at a relatively low infeed rate with spark-out stages after each of the rough and finish grind stages, the duration of the spark-out stage after rough grinding is made dependent on the condition of the grinding wheel and corresponds to the time needed for removing workpart material for the reduction of the grinding wheel motor power from the high rough grind level to the lower finish grind level. The duration of the spark-out stage will therefore be variable from one workpart to the next as the condition of the wheel changes. In addition, the interval of wheel retruing or dressing (i.e. number of workparts ground between wheel retruing) is variable as determined by the condition of the wheel. In particular, when the rough spark-out stage for a workpart is completed in a time shorter than a preselected minimum time indicative of a wheel that is in need of retruing. Typically, the occurrence of a drop in wheel motor power from the rough to the finish level during the preselected time interval is sensed and activates a memory circuit to store the fact that the machine needs to be placed in the wheel truing mode.

7 Claims, 5 Drawing Figures

SUPERABRASIVE GRINDING WITH VARIABLE SPARK-OUT AND WHEEL DRESSING INTERVALS

FIELD OF THE INVENTION

The invention relates to grinding processes especially those using superabrasive grinding wheels.

BACKGROUND OF THE INVENTION

During precision grinding operations it is necessary to adjust the grinding cycle of the grinding machine to accommodate changes in the condition of the superabrasive wheel from the time the wheel was last trued or dressed until the time it must be trued or dressed again. In particular, superabrasive wheels, such as known cubic boron nitride and diamond wheels, tend to increase in sharpness as workparts are ground to the point where loss of the abrasive component becomes excessive and destructive of the wheel and tolerance achievable on the workpart.

In the past, such wheel changes have been accommodated both during the rough grind stage involving relatively high wheel infeed rates, e.g. 0.001 inch/second, and the finish grind stage involving relatively low infeed rates, e.g. 0.00025 inch/second relative to the workpart by continuously monitoring electrical power consumed by the grinding wheel drive motor, and inputting signals from a watts transducer used to monitor drive motor electrical power consumption into the microprocessor of the machine CNC control unit which automatically controls and varies the wheel infeed rate so as to keep the wheel drive motor power consumption substantially constant at a set high level for rough grinding and a set lower level for finish grinding.

Also, in the past, a so-called timed spark-out stage followed the rough grind stage and the finish grind stage during which the infeed rate of the wheel is zero relative to the workpart and is maintained until a selected threshold grinding force is reached where no substantive grinding occurs. The rough spark-out stage and finish spark-out stage were timed from the standpoint that an arbitrary time duration was programmed into the machine CNC control unit for each of these stages with no consideration given of the possible different conditions of the wheel that might exist after the rough and finish grind stages from one workpart to the next during a grinding run involving multiple workparts.

Retruing or dressing of the superabrasive grinding wheel was also set or timed to occur at an arbitrary preselected interval, typically after a certain selected number of workparts had been ground, e.g. one truing pass over the wheel for every ten workparts ground. In some applications, this truing procedure does not maintain the condition of the grinding wheel at or near its optimum as a result of variations in the wheel structure, the workpiece structure, or stock removal rate from the wheel or workpiece.

U.S. Pat. No. 3,344,560 issued Oct. 3, 1967, illustrates controlling wheel feed rate by sensing deflection of the grinding wheel spindle and U.S. Pat. 3,555,741 discloses controlling grinding force in response to signals from a proximity gage. In U.S. Pat. No. 3,344,560 a noncontact type of sensing device for spindle deflection controls the length of rough, finish and spark-out periods of the grind cycle.

SUMMARY OF THE INVENTION

An object of the invention is to provide a grinding method using a superabrasive wheel wherein the arbitrary timed spark-out stage after the rough grind stage is eliminated in favor of a variable duration spark-out stage dependent on the actual condition of the grinding wheel at that point.

Another object of the invention is to provide such a grinding method wherein the selected set interval for wheel truing or dressing is eliminated in favor of a variable truing or dressing interval dependent on the wheel condition at the rough or finish spark-out stages as evidenced by certain sensed parameters existing during the rough spark-out stage.

In a typical working embodiment of the invention, the spark-out stage after the rough grind stage is of variable duration from workpart to workpart determined by the time necessary for workpart material removal at zero wheel infeed rate to cause the grinding wheel drive motor power consumption to drop from the high level selected for rough grinding to the low level for finish grinding. The duration of the rough spark-out stage will depend on the condition of the grinding wheel, being shorter as the sharpness of the wheel increases during successive workpart grinding, and thus the duration of the rough spark-out stage is an indication of the condition of the wheel.

When the duration of the rough spark-out stage becomes shorter than a selected short time interval indicative of excessive wheel sharpness, the CNC control unit of the grinding machine places the machine in the wheel truing or dressing mode and this interval between truing or dressing is variable depending on the condition of the wheel itself, and is not fixed or set to occur after a selected number of workparts has been ground. Typically, a watts transducer senses grinding wheel drive motor power consumption over the selected short time interval and if the power consumption drops to that level for the low finish grind level within the short period, a memory circuit in the control unit is activated to store the fact that the machine needs to be placed in the truing or dressing mode.

BEST MODE FOR CARRYING OUT THE INVENTION

Figure 1:
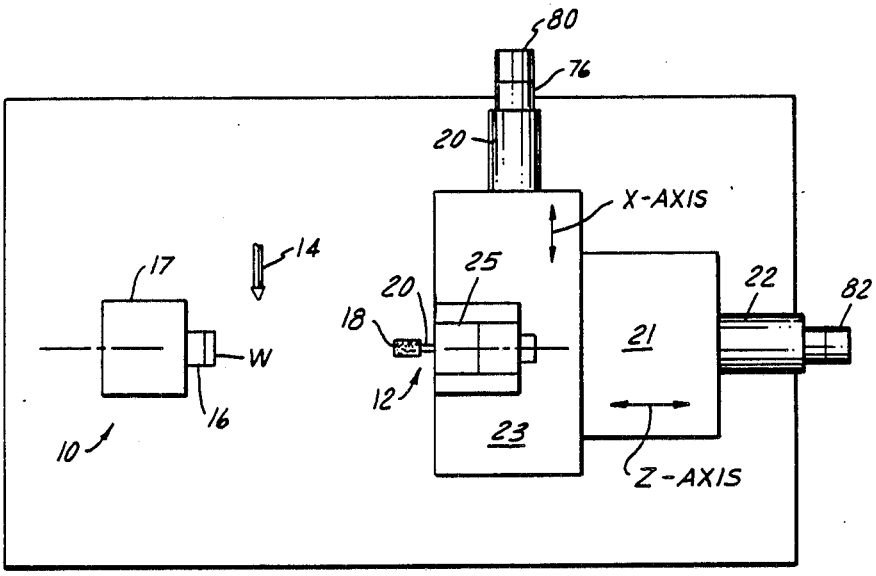
FIG. 1 is a schematic illustration of a grinding machine useful for practicing the method of the invention.

FIG. 1 illustrates schematically an internal grinding machine with a workhead 10, wheelhead 12 and wheel dresser 14 for use in practicing the method of the invention. The workhead 10, wheelhead 12 and dresser 14 are of conventional construction, a grinding machine having such components being available as model B or under the trademark LECTRALINE grinding machine from Bryant Grinder Corporation, Springfield, Vt.

As is well known, the workpart W is chucked in chuck 16 of the workhead and is rotated by the workhead spindle 17 during grinding but at a lesser speed of revolution than the speed at which the grinding wheel 18 is rotated by spindle 20 of the wheelhead motor 25. The grinding wheel is of the superabrasive type; e.g. cubic boron nitride or diamond, which sharpens during grinding eventually to the extent that the abrasive working component (cubic boron nitride or diamond) is excessively exposed from the bonding matrix of the wheel and results in excessive loss thereof from the wheel with concomitant adverse effect on wheel performance and ground workpart quality. Dressing or truing of the grinding wheel 18 with dresser 14 returns the wheel to a less sharp state that is optimum for high tolerance grinding.

Figure 2:
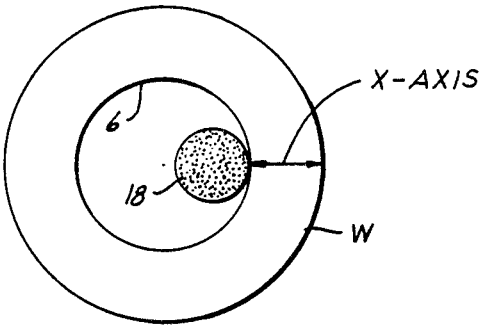
FIG. 2 is an enlarged view of the workpiece and grinding wheel.

The grinding wheel 18 is reciprocated axially inside the bore 6 of the chucked workpart W while being radially fed (fed in the X-axis direction, FIG. 2) against the bore wall 6 in grinding relation at appropriate radial or X-axis infeed rates for rough grinding and finish grinding described below. Reciprocating movement of the grinding wheel in the workpart bore is effected by a Z-axis slide 21 which moves back and forth in the Z direction, and radial or X-axis infeeding of the wheel against the bore wall is effected by an X-axis slide 23 movable in the Z-direction, all as is well known, e.g. as shown in the Reda et al U.S. Pat. No. 4,419,612 issued Dec. 6, 1983, the teachings of which are incorporated herein by reference.

Internal grinding of bore wall 6 is effected in a successive rough grind stage, rough spark-out stage, finish grind stage and finish spark-out stage. During rough grinding, the wheel radial infeed rate against the bore wall is relatively high; e.g. 0.001 inch/second while during finish grind the radial infeed rate of the wheel is relatively low; e.g. 0.00025 inch/second. These infeed rates are of course provided by movement of the X-axis slide 23 under suitable servo loop control using a ball screw drive controlled by the CNC control unit 62 of the machine, FIG. 3, e.g. as described in the aforementioned Reda et al U.S. Pat. No. 4,419,612 and hereinafter. During, both rough and finish spark-out (also referred to in the art as dwell or tarry), the grinding wheel is maintained by the X-axis slide 23 in contact with the bore wall 6 with an essentially zero radial infeed rate of the wheel until grinding force decreases to or near the so-called threshold level below which no further grinding of the workpart occurs as is well known. Spark-out is then terminated. The workpart is unloaded after finish grinding when the finish spark-out phase is terminated or when an optional end position (of wheel feed) or gage size (of bore 6) is reached.

Figure 3:
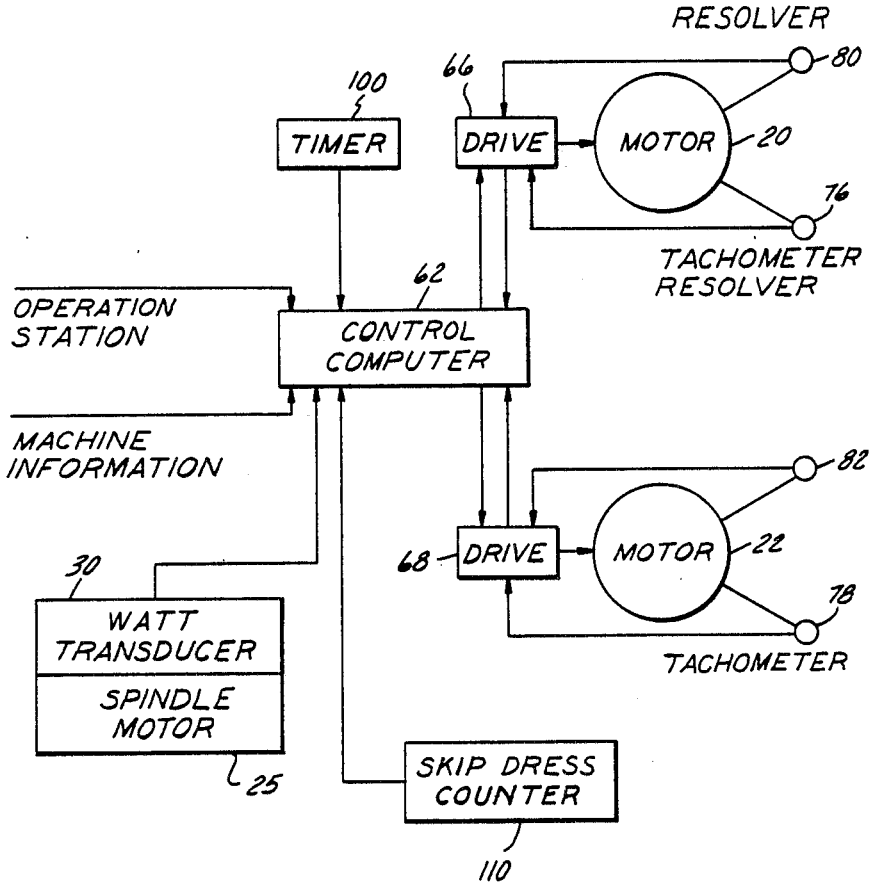
FIG. 3 is a block diagram of an exemplary machine control system for carrying out the method of the invention.

Referring to FIG. 3, there is shown a watts transducer 30 or other device functioning as a watt meter to monitor power consumption of spindle motor 25 during grinding and to provide in closed servo-loop manner signals representative of motor power consumption to a control computer 62 which is programmed to control all machine functions and interlocks which may include lubrication status, safety interlocks, motor watt consumption status and operation control station information. The watts transducer 30 is shown adjacent to spindle motor 25 for convenience purposes; in practice, the watts transducer is located in a control cabinet adjacent to the grinding machine. The control computer 62 may be any suitable digital computer or microprocessor. The control computer has stored the positions and rates for all the axis moves for the various operational sequences which include but are not limited to a rough grind, rough spark-out, finish grind and finish spark-out constituting a grind cycle, wheel dressing or truing cycle and so forth. The control computer 62 sends servo-drive signals to the servo-drive means 66,68 for controlling the servo-motors 20,22 with respect to the X-axis and Z-axis slides to cause the grinding wheel to move. The servo-drive means 66,68 take feedback from tachometers 76,78, respectively. The numerals 80,82 designate either resolvers, encoders, or "INDUCTOSYN" transducers and they provide feedback signals to the drive means 66,68, respectively, in closed servo-loop manner with the tachometers.

A suitable control computer 62 is available from Intel Corp., Santa Clara, Calif. 95054 and sold as an 86/05 Single Board Computer. The servo-drive means 66,68 may be any suitable servo-drive means as, for example, a SPR/X-1152 servo-drive available on the market from Inland Motor Division, Kollmorgen Corporation, 201 Rock Road, Rodford, Va. 24141.

The servo-motors 20,22 may be any suitable D.C. or A.C. servo-motor. Suitable D.C. servo-motors are available from Torque Sytems Inc., 225 Crescent St., Waltham, MA 02154 under the trademark "SNAPPER". The tachometers 76,78 are part of the respective D.C. servo-motors. The resolvers, encoders or INDUCTOSYN transducers 80,82 are commercially available items and may be any suitable conventional position feed back device on the market for example as described in the aforementioned Reda et al U.S. Pat. No. 4,419,612. The watts transducer 30 likewise is commercially available from A.F. Green Co., 15 Kelley Road, Salem, MA. 01970.

In practicing the method of the invention, each workpart in a grinding run or sequence is subjected to the rough grind, rough spark-out, finish grind and optional finish spark-out stages with the duration of the rough spark-out stage being variable dependent upon the actual condition of the grinding wheel and with the interval for truing or dressing of the grinding wheel also being variable during a run involving grinding multiple workparts in succession or from run to run dependent on the actual condition of the grinding wheel, not for an arbitrary selected duration and interval, respectively, as employed heretofore in the art.

For rough grinding the first workpart of a run, the grinding wheel 18 is first trued or dressed to proper dimension and sharpness by dresser 40 which may be a rotary dresser or other known dresser construction for superabrasive grinding wheels. After chucking on the workhead spindle 17, the workpart is ground by reciprocating the grinding wheel inside the workpart bore in the Z-direction and radially infeeding the wheel in the X-direction at a selected rough infeed rate; e.g. 0.001 inch/second, until the desired workpart bore ID (inner diameter) dimension is obtained as evidenced by wheel feed having reached a preset rough endpoint feed position (in the X-direction). The watts transducer 30 inputs wheel drive motor power consumption signals to the control computer 62 which, in turn, outputs necessary signals for controlling and varying the rough cycle infeed rate so as to maintain the power consumed by the drive motor substantially constant.

Once the desired workpart bore ID dimension is achieved during rough grinding, the wheel is maintained in position to provide a substantially zero infeed rate constituting the rough spark-out stage. During this rough spark-out stage, the grinding wheel removes some material from the workpart bore and results in a reduction in drive motor power consumption from the high level associated with rough grinding to a low level associated with finish grinding. The length of time requried for the power level to drop to the finish grind level depends on the condition of the grinding wheel and decreases as the wheel sharpens during successive grinding of multiple workparts, eventually reaching an unwanted condition of high sharpness where the abrasive component of the wheel, e.g. the cubic boron nitride or diamond held in a bond matrix are excessively exposed and prone to excessive dislodgement and loss from the matrix. In general, as multiple workparts are successively ground, the wheel exhibits a gradual progressive tendency to sharpen as a result of increased exposure of the abrasive component from the matrix. Generally, the duration of the spark-out stage is variable in time and decreases from one workpart to the next as they are successively ground according to the invention. A variable time spark-out stage is thus provided and is dependent in duration on the condition of the grinding wheel.

The dependence of the time of the rough spark-out stage on the condition of the grinding wheel is used to determine the interval for retruing or dressing the grinding wheel as described hereinafter. In accordance with one embodiment of the invention and with reference to FIG. 4, a timer control 100 on a conventional Model B or LECTRALINE grinding machine referred to above and previously used by prior art workers to set or fix arbitrarily the duration of the rough spark-out stage is set to establish a minimum reference time interval, e.g. 2 seconds, which is stored in control computer 62 and which is indicative of a wheel in need of truing or dressing if the drive motor power consumption drops to the finish level in that time. The watts transducer 30 likewise interfaces with the control computer 62 and inputs drive motor power consumption signals thereto. The control computer during the rough spark-out stage for each workpart is programmed to determine whether the drive motor power consumption level drops from the high level associated with rough grinding to the low level associated with finish grinding within the reference time interval. If the drive motor power consumption does not drop to the lower level within the reference time interval, the control computer directs the finish grinding of that workpart and regulates the finish feed rate (using increase feed rate and decrease feed rate boxes of FIG. 4) and then directs the start of grinding of another successive workpart. On the other hand, if the drive motor power consumption does drop to the lower level within the reference time interval indicative of a wheel in need of truing or dressing as described herebelow, the control computer 62 stores the fact for future reference, directs the finish grinding of that workpart, then outputs appropriate signals to the slide motor drives 66 and 68 and dresser 14 to retrue the wheel, and then outputs appropriate signals for start of grinding additional workparts. The process continues until the duration of the rough spark-out stage for a particular workpart is again shorter than the reference time interval. The wheel is then retrued as described and the sequence repeated for additional workparts throughout the grinding run or from run to run. The advantageous feature of this method is that wheel retruing or dressing is conducted on an interval (after certain number of workparts) which is dependent on the condition of the grinding wheel as evidenced by the duration of the rough spark-out stage, and not some arbitrary set interval. The minimum reference time interval is determined empirically based on observations as to when a wheel in fact is in need of truing or dressing. As a result, the grinding wheel is trued or dressed when warranted by the condition of the wheel as evidenced by its sharpness during the rough spark-out stage. By having a truing or dressing interval variable with the condition of the wheel, and not set at some arbitrary interval, the wheel can be maintained in better condition during grinding runs and will enhance productivity of ground workparts and life of the grinding wheel.

As shown, a conventional skip dress counter 110 is provided to count workparts unloaded after finish grinding to assure that retruing occurs at least after a selected number of workparts have been ground regardless of the sharpness of the grinding wheel as indicated by the duration of the rough spark-out stage. The skip dress counter assures retention of wheel straightness despite possibly uneven wear of the wheel.

Following rough grinding and rough spark-out as described hereinabove, each workpart is subjected to a finish grind at a relatively low infeed rate; e.g. 0.00025 inch/second which may optionally be terminated by an in-process gage which measures workpart size, followed by no spark-out or a timed (fixed time) finish spark-out stage, or a spark-out which is terminated by an in-process gage, to grind to the final high tolerance bore ID desired in accordance with prior art practice. Subsequent workparts are then subjected to the rough grind, rough spark-out, finish grind and optional finish spark-out stages of the grinding cycle until the wheel requires truing or dressing again as evidenced by the duration of the rough spark-out stage.

Figure 4A:
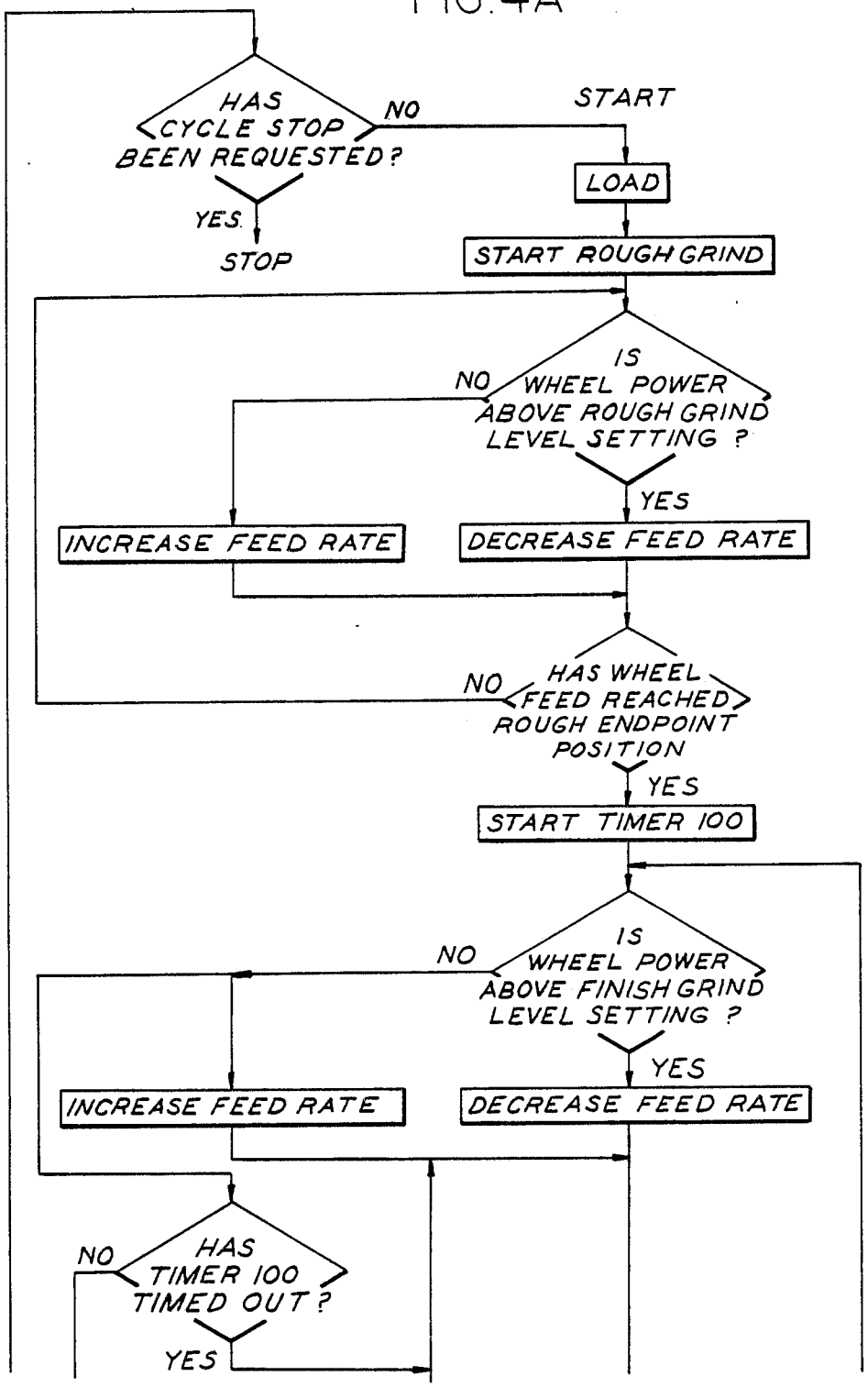
FIG. 4A and 4B, when viewed with the bottom of FIG. 4A aligned with the top of FIG. 4B, show a flow chart of the decision-making process involving the grinding wheel drive motor watts transducer and the spark-out timer for placing the machine in the wheel dress mode.
Figure 4B:
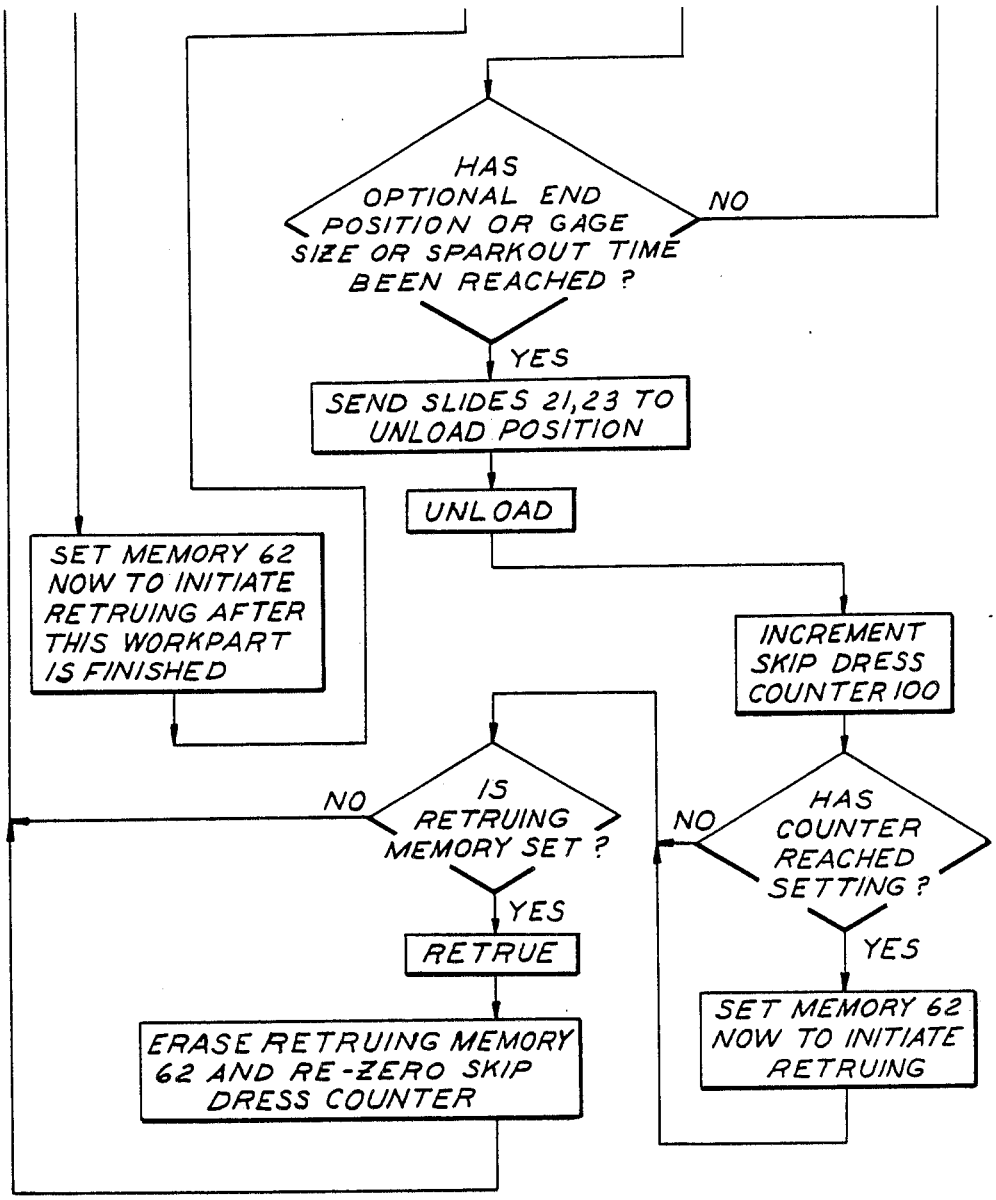

FIG. 4 illustrates schematically the flow chart for the inventive method described hereinabove.

Although certain preferred features and embodiments of the invention have been described hereinabove and illustrated in the Figures, it is to be understood that modifications and changes may be made therein without departing from the spirit and scope of the invention as defined in the appended claims.

I claim:

1. In a method for grinding multiple workparts in succession with a superabrasive grinding wheel driven by an electrical drive motor wherein sharpness of the wheel progressively increases from one workpart to the next and each workpart is subjected to a first grind stage at a first level of drive motor power consumption, a spark-out stage following the first grind stage and a second grind stage at a second lower level of drive motor power consumption, the steps of conducting the spark-out stage for the workparts for a time until the drive motor power consumption falls from the first level to the second level as determined by the condition of the grinding wheel for a particular workpart, truing the grinding wheel when the duration of the spark-out stage for a workpart becomes shorter in duration than a selected time indicative of an overly sharp wheel requiring retruing and grinding the next successive workpart with the trued grinding wheel.

2. The method of claim 1 wherein the first grind stage is rough grinding at a relatively high wheel infeed rate and the second grind stage is finish grinding at a relatively low wheel infeed rate.

3. The method of claim 1 wherein the drive motor power consumption is monitored during the spark-out stage.

4. The method of claim 3 wherein the drive motor power consumption is also monitored during the first grind stage and second grind stage.

5. The method of claim 1 wherein truing of the grinding wheel is programmed when the drive motor power consumption falls from the first level to the second level during a preselected short time interval entered into the control system of a grinding machine on which the grinding wheel is operational.

6. The method of claim 1 including repeating the steps recited as additional workparts are ground in succession.

7. In a grinding machine having a superabrasive grinding wheel driven by an electrical drive motor to subject multiple workparts in succession to a rough grind at rough drive motor power consumption, spark-out following rough grinding and a finish grind at drive motor power consumption lower than that for rough grinding wherein sharpness of the wheel progressively increases from one workpart to the next, means for monitoring drive motor power consumption during spark-out and control means responsive to the monitoring means for effecting truing of the grinding wheel whenever the duration of the spark-out stage for a particular workpart becomes shorter than a selected time indicative of a wheel in need of truing with truing occurring after the particular workpart is ground and before the next workpart is ground.

* * * * *